US005584404A

United States Patent [19]

Tsai

[11] Patent Number: 5,584,404

[45] Date of Patent: Dec. 17, 1996

[54] ADJUSTABLE DOUBLE-DECKER RACK

[76] Inventor: Hank Tsai, P.O. Box 82–144, Taipei, Taiwan

[21] Appl. No.: 407,120

[22] Filed: Mar. 20, 1995

[51] Int. Cl.[6] ..... A47F 5/08

[52] U.S. Cl. ..... 211/94; 211/87; 211/90; 108/29

[58] Field of Search ..... 211/87, 90, 94, 211/94.5, 105.1; 108/29

[56] References Cited

U.S. PATENT DOCUMENTS

| | | | |
|---|---|---|---|
| 665,877 | 1/1901 | Clarke | 211/87 |
| 911,651 | 2/1909 | Erickson | 211/94 |
| 1,654,341 | 12/1927 | Mendiolagoitia | 211/90 X |
| 1,836,008 | 12/1931 | Anzalone | 211/94 |
| 2,024,892 | 12/1935 | Soper | 211/87 X |
| 2,568,598 | 9/1951 | Traverso | 211/87 X |
| 2,633,998 | 4/1953 | Derman | 211/90 X |
| 2,946,458 | 7/1960 | Boff et al. | 211/94.5 X |
| 4,907,706 | 3/1990 | Henderson | 211/94 X |

FOREIGN PATENT DOCUMENTS

| | | | |
|---|---|---|---|
| 2669353 | 5/1992 | France | 211/87 |
| 645542 | 9/1962 | Italy | 211/94.5 |

*Primary Examiner*—Leslie A. Braun
*Assistant Examiner*—Richard M. Smith
*Attorney, Agent, or Firm*—Alfred Lei

[57] ABSTRACT

An adjustable double-decker rack including an upper shelf having a pair of fixing members, a pair of brackets each having a body portion engageable with the fixing members, a plurality of plugs each having a conical portion at one end and a collet portion at another end, a plurality of tubular members each connected at both ends with the conical portion of one of the plugs, and a tray adapted to dispose on the tubular members, and a lower shelf having a pair of movable frames each engaged with a lower portion of a corresponding one of the brackets and having a plurality of holes, a pair of main supporting rods each having an end engaged with the female connector of each of the movable frames, a plurality of plugs each having a conical portion at one end and a collet portion at another end, and a plurality of tubular members each connected at both ends with the conical portion of one of the plugs, whereby the lower shelf can be pulled out of the upper shelf in order to increase the capacity of the rack as required.

4 Claims, 8 Drawing Sheets

ADJUSTABLE DOUBLE-DECKER RACK

BACKGROUND OF THE INVENTION

1. Field of the Invention

This invention relates to a rack which is adjustable and possessed of two shelves.

2. Description of the Prior Art

It has been found that the conventional rack is simply composed of two brackets and a board mounted on the two brackets. However, once a towel is hanged on the rack, it will be almost impossible to put any other things thereon. Besides, such a rack is easily disengaged from the wall thereby causing much trouble. In addition, when the rack is to be fixed on a wall of tiles, the tile(s) will be damaged if the length of the rack is not just equal to the distance between the tiles.

Therefore, it is an object of the present invention to provide an improved rack which can obviate and mitigate the above-mentioned drawbacks.

SUMMARY OF THE INVENTION

This invention relates to an adjustable double-decker rack.

It is the primary object of the present invention to provide a rack which is adjustable and possessed of two shelves.

It is another object of the present invention to provide an adjustable double-decker rack which is practical in use.

It is still another object of the present invention to provide an adjustable double-decker rack which is simple in structure.

It is still another object of the present invention to provide an adjustable double-decker rack which is sturdy in construction.

It is a further object of the present invention to provide an adjustable double-decker rack which is convenient and easy to use.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

BRIEF DESCRIPTION OF THE DRAWINGS

FIG. 14 is a perspective view of the present invention;

DETAILED DESCRIPTION OF THE PREFERRED EMBODIMENT

Figure 1:
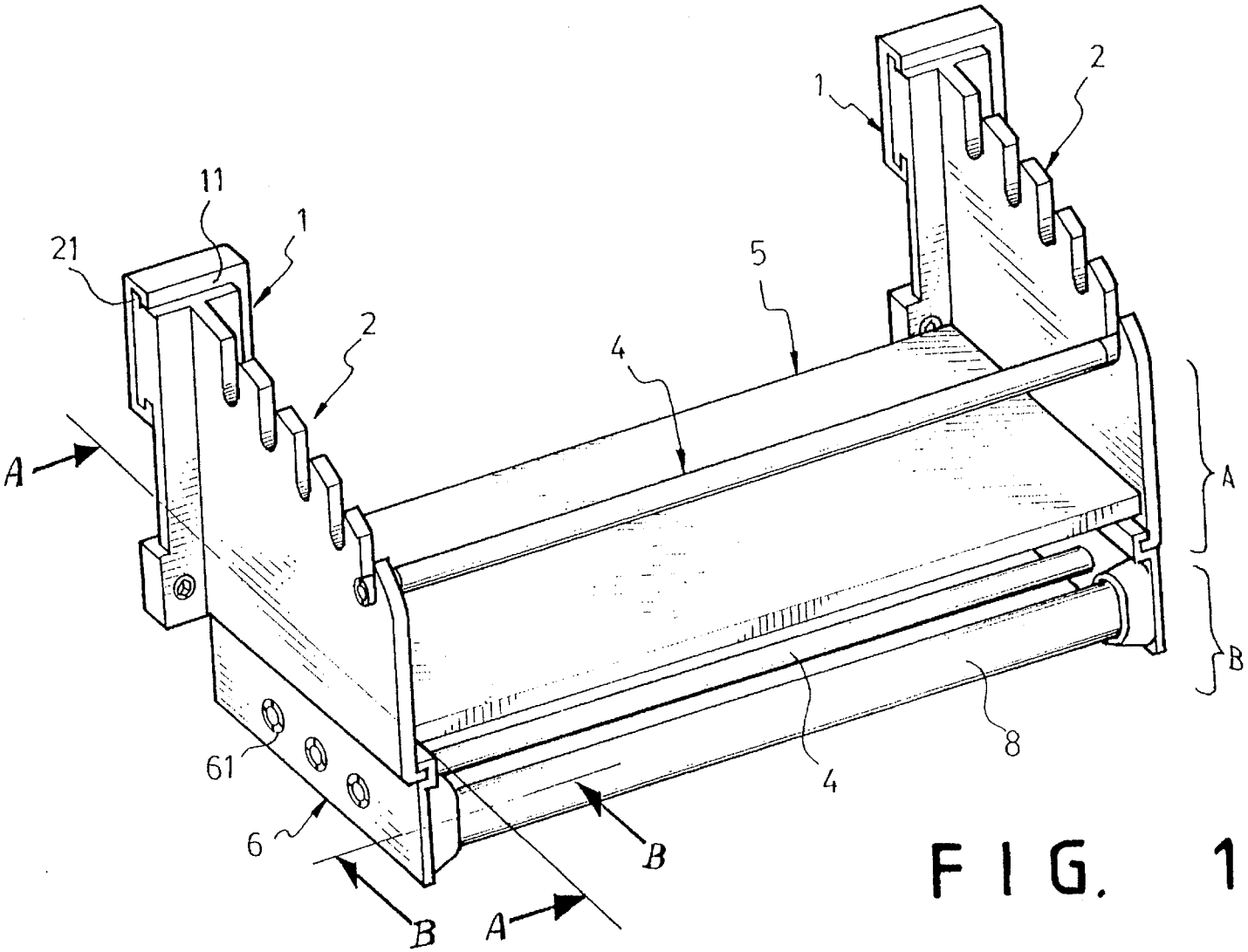

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
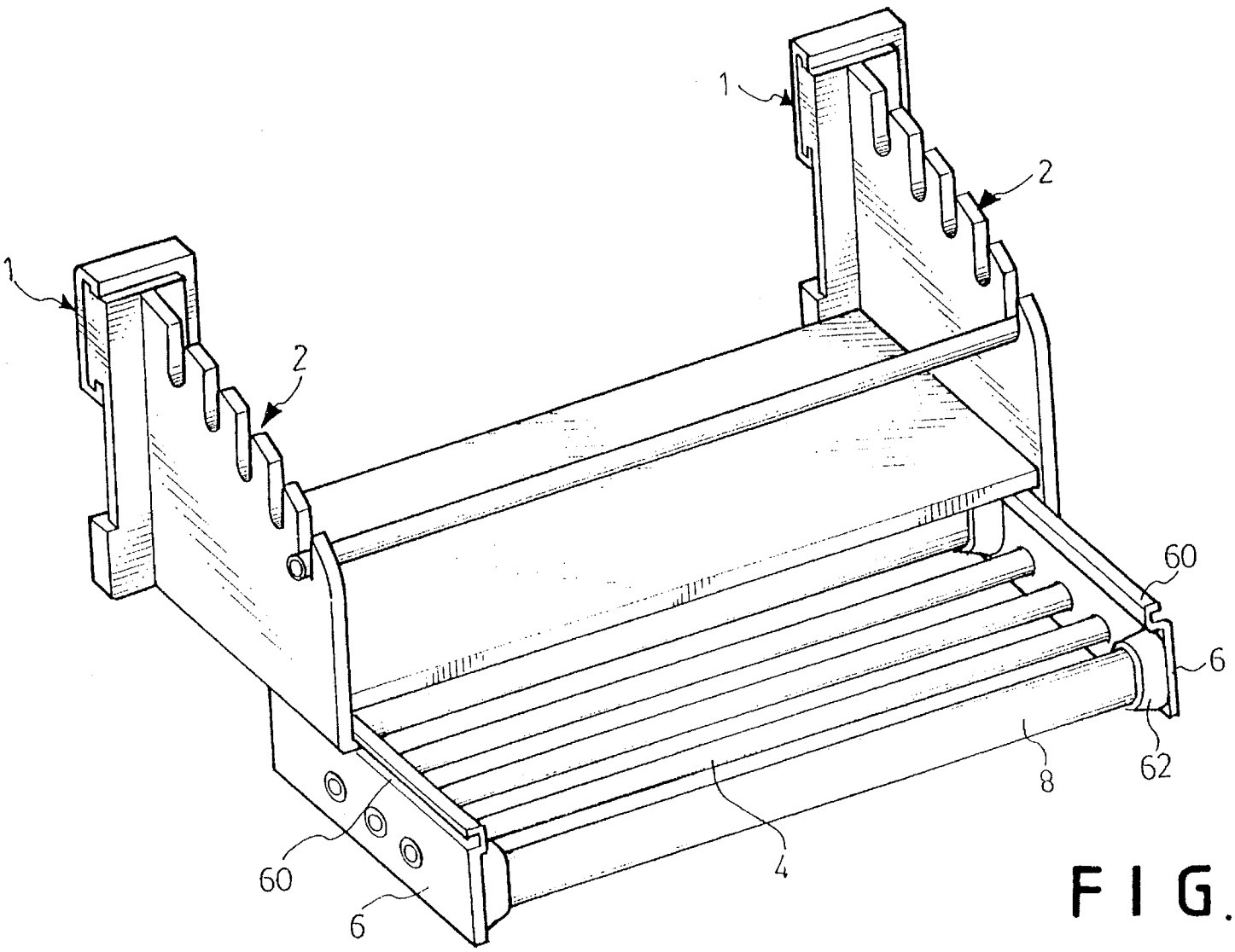
FIG. 2 is a perspective view of the present invention, shown with the upper shelf removed.

With reference to the drawings and in particular to FIGS. 1 and 2 thereof, the adjustable double-decker rack according to the present invention comprises an upper shelf A and a lower shelf B which can be slid out as required.

Referring to FIGS. 1, 2, 3 and 7, the upper shelf A includes a pair of fixing members 1, a pair of brackets 2, a plurality of tubular members 4, a plurality of plugs 3, and a tray 5.

The fixing member 1 is a rectangular body formed with a recess 10 having a flange 11 at its three sides and open at one of its vertical side. The recess 10 has a circular hole 13 and an elongated slot 12. The fixing member 1 is designed to be rigidly mounted on a wall by a first screw 15 extending through the circular hole 13 into the wall and a second screw (not shown) through the elongated slot 12 into the wall.

Figure 3:
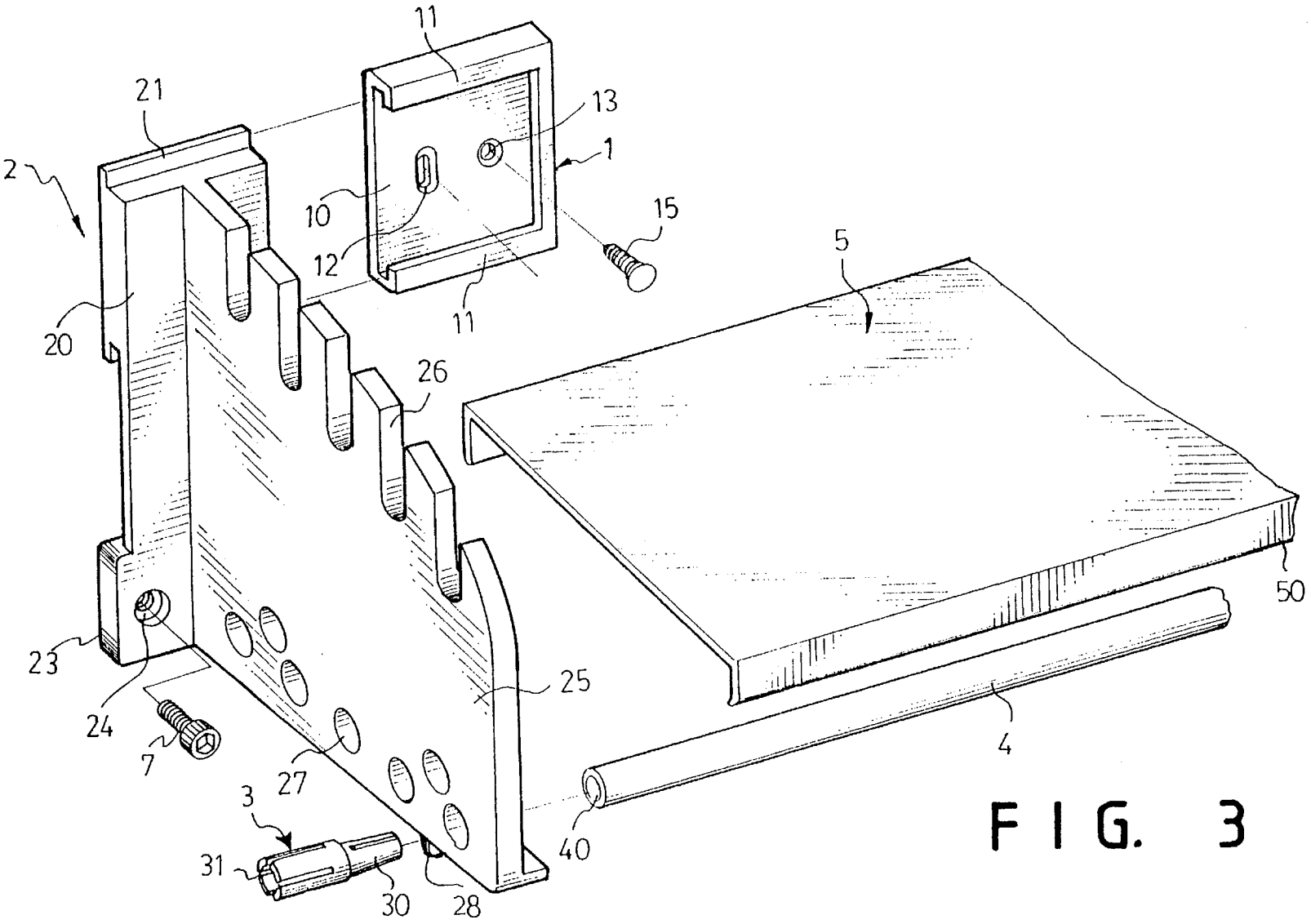
FIG. 3 is a fragmentary perspective view of the present invention.

The bracket 2 includes a body portion 20 which is formed with two parallel flanges 21 adapted to be received in the recess 10 of the fixing member 1. The body portion 20 has an opening 24 at the lower end 23 for the passage of a screw 7. Further, the bracket 2 is provided with an arm 25 vertically extending from the body portion 20. The arm 25 has a plurality of U-shaped notches 26 on its upper portion and a plurality of holes 27 (which are shown only in FIG. 3 for simplicity) at its lower portion. Each of the holes 27 is engageable with a plug 3 having a conical portion 30 at one end and a collet portion 31 at the other. Only one plug 3 is shown in FIG. 3 for simplicity. In addition, the arm 25 is provided with a protuberance 28 at the bottom close to its outer end. Moreover, the arm 25 of each bracket 2 is formed with a flange 29 (see FIG. 4) at its lower inner edge.

The tubular member 4 is formed with an opening 40 at both ends. The tubular member 4 is designed to be supported by the U-shaped notches of the arms 25 of the body portions 20. Further, two tubular member 4 are each supported between two plugs 3 fitted in the brackets 2.

The tray 5 is an inverted U-shaped member having two depending legs 50 and is simply arranged on the two tubular members 4 mounted between the two brackets 2.

Figure 4:
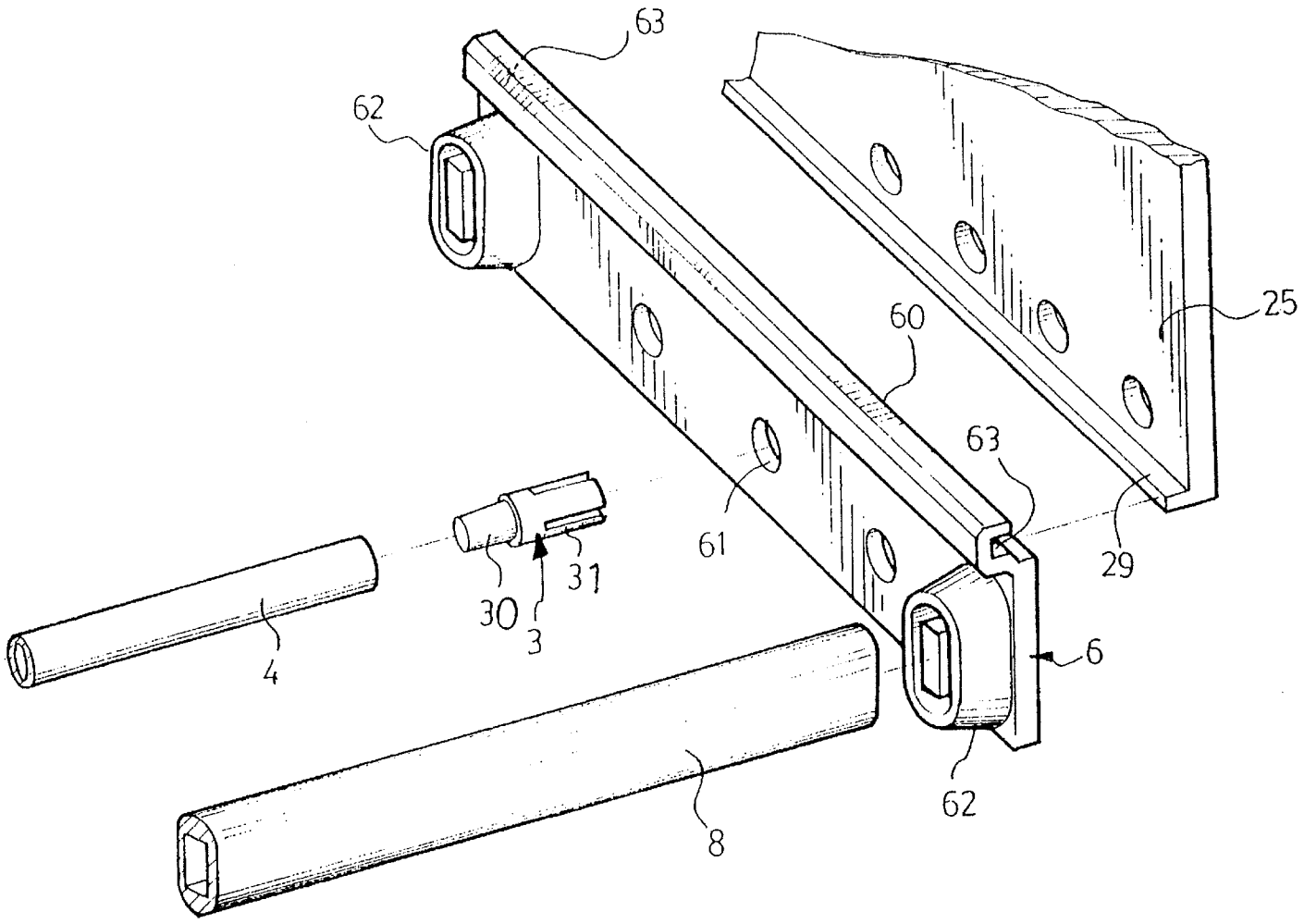
FIG. 4 is another fragmentary perspective view of the present invention.
Figure 5:
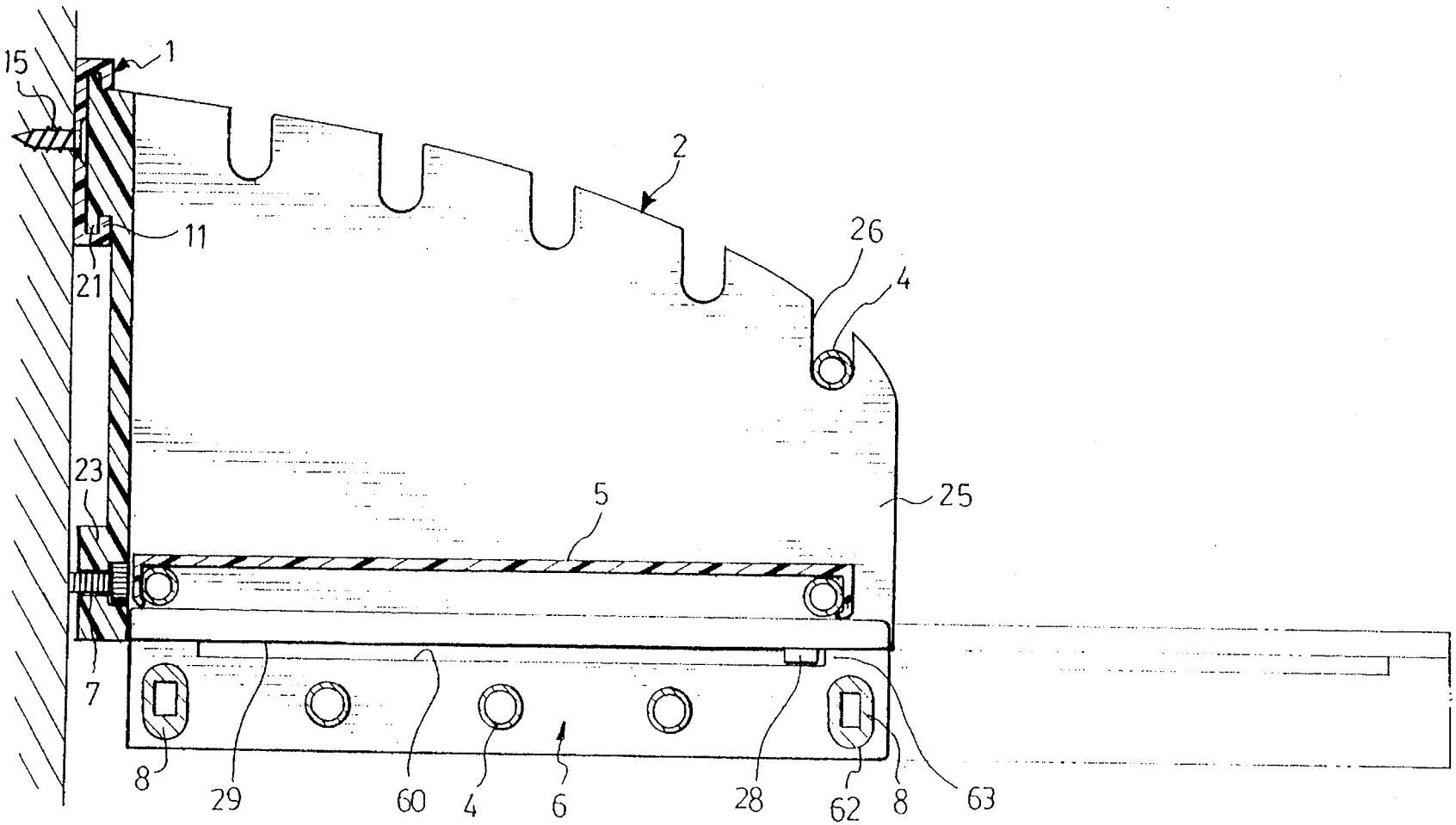
FIG. 5 is a sectional view taken along line A—A of FIG. 1.
Figure 6:
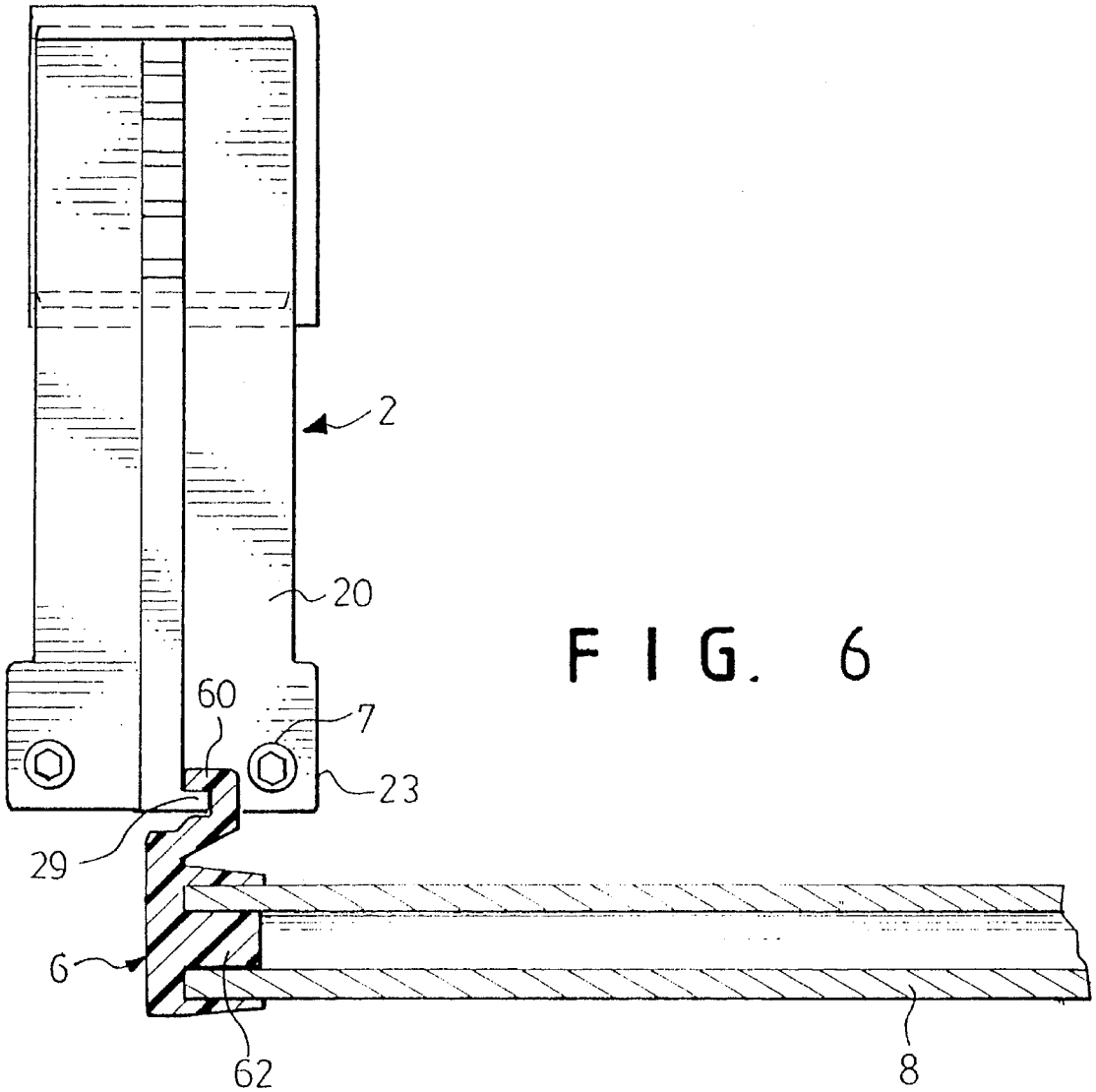
FIG. 6 is a sectional view taken along line B—B of FIG. 1.
Figure 7:
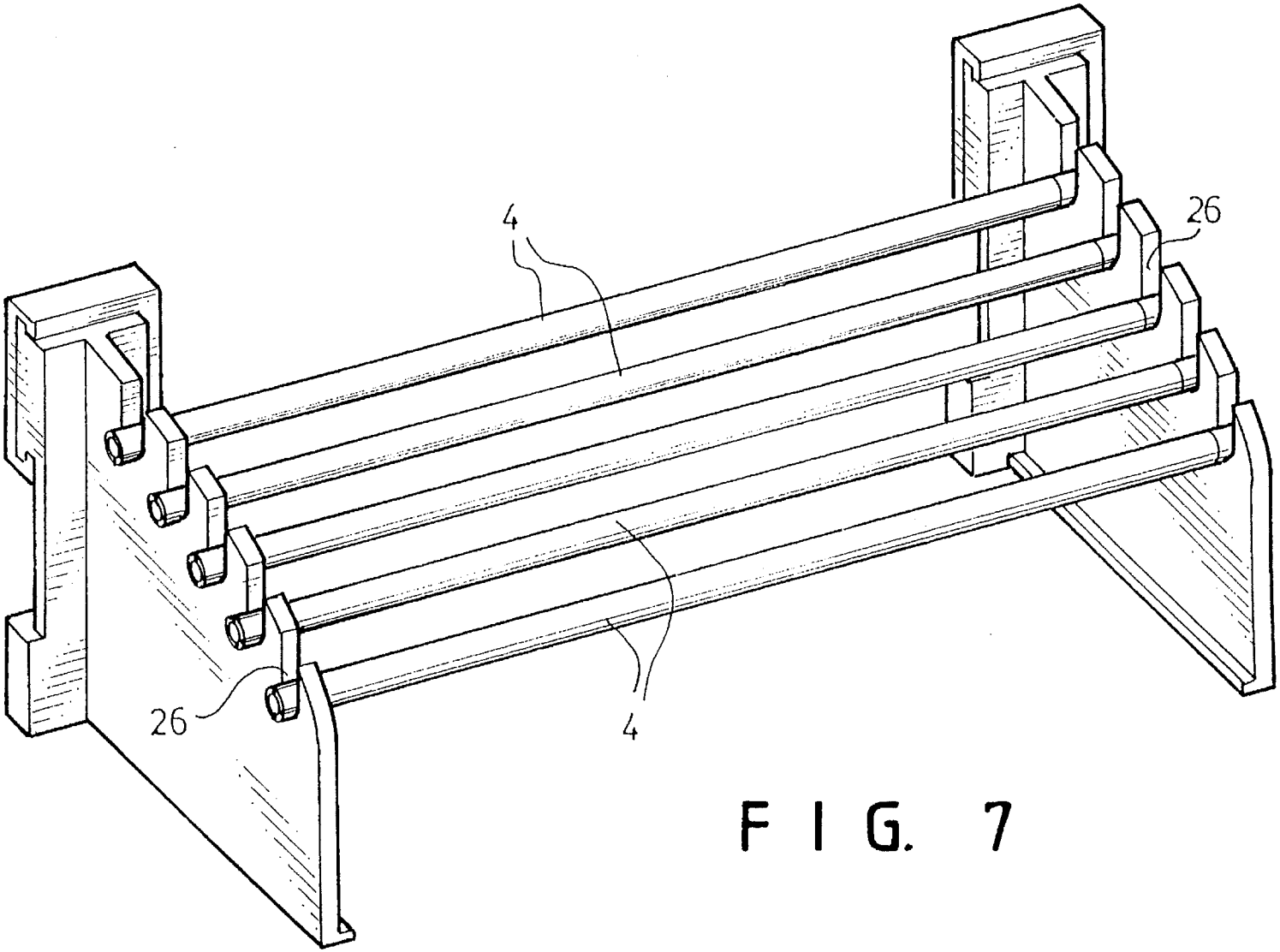
FIG. 7 is a perspective view of the upper shelf.

Looking now at FIGS. 4, 5 and 6, the lower shelf B includes a pair of movable frames 6, a pair of main supporting rods 8, a plurality of tubular members, and a plurality of plugs 3.

The movable frame 6 has a groove 60 adapted to receive the flange 29 of the upper shelf A and the groove 60 is provided with a stopper 63 at the outer end adapted for preventing the protuberance 28 of the bracket 2 of the upper shelf A to pass over. Hence, the lower shelf B can be moved with respect to the upper shelf A without disengaging therefrom. Further, the movable frame 6 is provided at both ends of its inner side with a female connector 62 adapted to engage with an end of the main supporting rod 8. The main supporting rod 8 is formed with an opening at both ends, and the female connector 62 of the movable frame 6 has an elliptical housing and a protrusion which is located at a center of the housing and adapted to engage with the opening of the main supporting rod 8. In addition, the movable frame 6 is formed with a plurality of holes 61 for receiving the collet ends 31 of the plugs 3. The tubular member 4 is engaged between the conical end 30 of two plugs 3.

Figure 8:
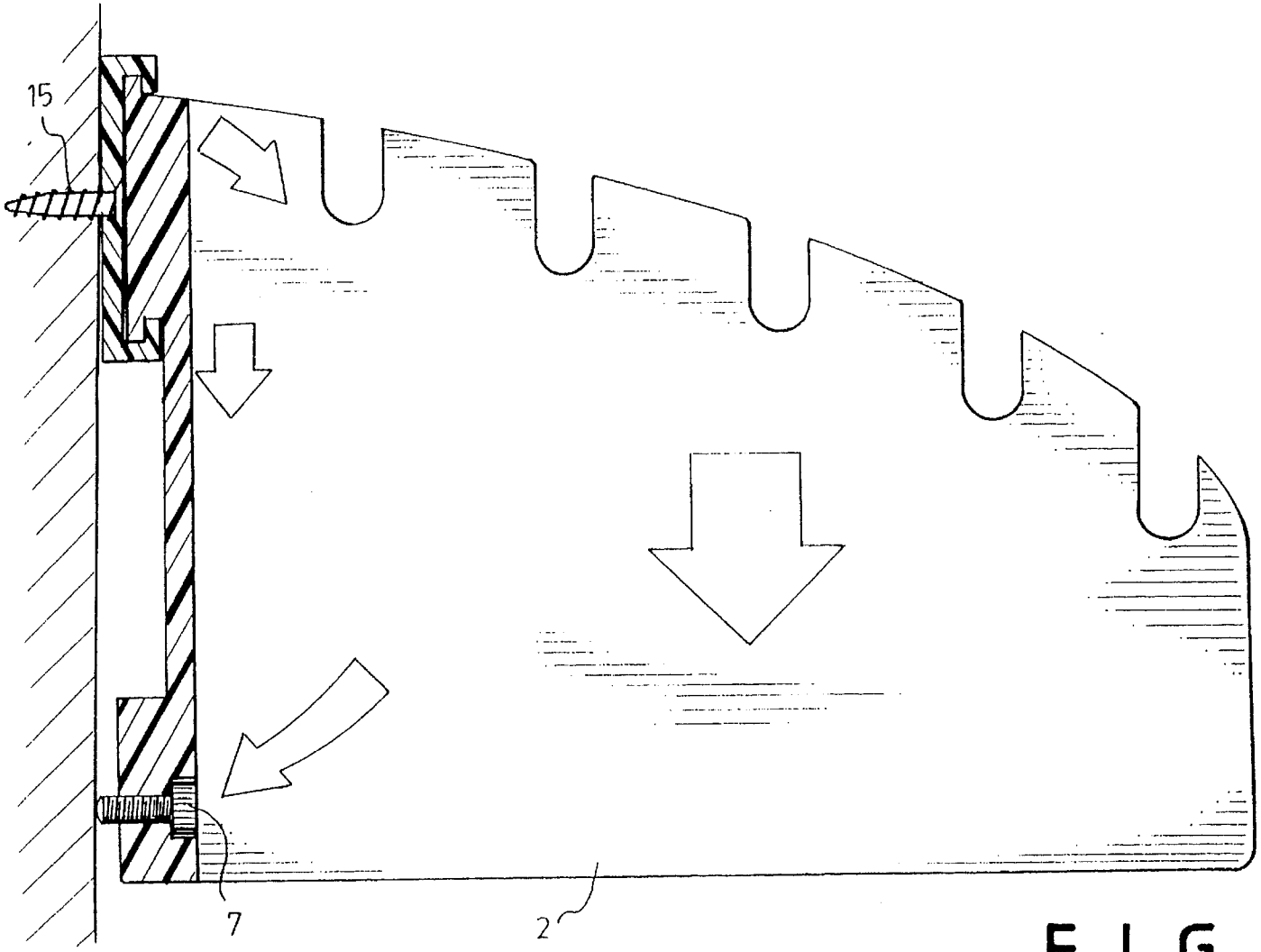
FIG. 8 is a sectional view showing the distribution of the force exerted on the present invention.

FIG. 8 is a sectional view showing the distribution of the force exerted on the present invention.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. An adjustable double-decker rack comprising:

an upper shelf including:

a pair of fixing members each having a recess;

a pair of brackets each having a body portion formed with two parallel flanges adapted to be received in the recess of one of said fixing members, said body portion being provided with an arm vertically extending therefrom, said arm having a plurality of U-shaped notches on an upper portion thereof and a plurality of holes at a lower portion thereof;

a plurality of plugs each having a conical portion at one end and a collet portion at another end and adapted to engage with the holes of said arm;

a plurality of tubular members each connected at both ends with the conical portion of one of said plugs; and a tray adapted to dispose on said tubular members; and lower shelf including:

pair of movable frames each engaged with a lower portion of a corresponding one of said brackets and having a plurality of holes, each of said movable frames being provided at both ends of an inner side with a female connector;

a pair3 of main supporting rods each having an end engaged with the female connector of each of said movable frames;

a plurality of plugs each having a conical portion a one end and a collet portion at another end and adapted to engage with the holes of sad movable frames; and a plurality of tubular members each connected at both ends with the conical portion of one of said plugs of the lower shelf.

2. The adjustable double-decker rack as claimed in claim 1, wherein the arm of each of said brackets is provided with a protuberance at a bottom close to an outer end thereof, and each of said movable members has a groove provided with a stopper at an outer end adapted for preventing said protuberance to pass over.

3. The adjustable double-decker rack as claimed in claim 1, wherein each of said main supporting rods is formed with an opening at both ends, and the female connector of each of said movable frame has an elliptical housing and a protrusion which is located at a center of said housing and adapted to engage with the opening of one of said main supporting rods.

4. The adjustable double-decker rack as claimed in claim 1, wherein said lower shell is slidably engaged with said upper shelf.

* * * * *